US005988084A

United States Patent [19]

Soutome et al.

[11] Patent Number: 5,988,084

[45] Date of Patent: Nov. 23, 1999

[54] WORKPIECE CLAMPING UNIT DRIVING MECHANISM FOR SEWING MACHINE

[75] Inventors: Kenichi Soutome; Shingo Murata; Naohisa Iso, all of Utsunomiya, Japan

[73] Assignee: The Singer Company N.V., Curacao, Netherlands

[21] Appl. No.: 09/103,400

[22] Filed: Jun. 24, 1998

[30] Foreign Application Priority Data

Sep. 18, 1997 [JP] Japan ..... 9-272199

[51] Int. Cl.[6] ..... D05B 21/00

[52] U.S. Cl. ..... 112/470.09; 112/470.18

[58] Field of Search ..... 112/470.09, 470.18, 112/65, 70, 459, 461, 465, 466

[56] References Cited

U.S. PATENT DOCUMENTS 3,399,640 9/1968 Bryan et al. ..... 112/470.18
3,543,737 12/1970 Maschmann ..... 112/470.09
3,970,016 7/1976 Yanikoski ..... 112/102.5
4,459,925 7/1984 Miyachi et al. ..... 112/70

*Primary Examiner*—Peter Nerbun
*Attorney, Agent, or Firm*—Cummings & Lockwood

[57] ABSTRACT

A sewing machine is provided with a workpiece clamping unit which clamps and carries a workpiece along the surface of the bed during stitching operation, and a workpiece clamping unit driving mechanism comprising a driving means and a motion converting means. The driving means comprises first and second drive shafts, first and second driving sources for driving the first and the second drive shaft, and first and second compound plate cams fixedly mounted respectively on the first and the second drive shafts. The motion converting means converts the angular motions of the first and the second drive shaft into motions parallel to the upper surface of the bed (6) of the sewing machine.

5 Claims, 6 Drawing Sheets

WORKPIECE CLAMPING UNIT DRIVING MECHANISM FOR SEWING MACHINE

BACKGROUND OF THE INVENTION

1. Field of the Invention

The present invention relates to a workpiece clamping unit driving mechanism for a sewing machine and, more specifically, to a workpiece clamping unit driving mechanism for a bar tacking machine, for moving a workpiece clamping unit clamping a workpiece in parallel to the upper surface of the bed of the bar tacking machine in predetermined directions for stitching operation.

2. Description of the Related Art

Workpiece clamping unit driving mechanisms of the foregoing kind are disclosed in, for example, JP-A No. 8-84877 and JP-B Nos. 60-27307 and 60-17548.

A workpiece clamping unit driving mechanism disclosed in JP-A No. 8-84877 is employed in a sewing machine comprising a workpiece clamping unit, and a workpiece carrying unit for carrying the workpiece clamping unit along the surface of a bed included in the sewing machine to change the position of the workpiece relative to a needle. The workpiece carrying unit comprises a motor disposed on the lower surface of the bed with its output shaft extended in parallel to a bed shaft included in the sewing machine, and a driving force transmitting mechanism for converting the output torque of the motor into a linear force acting in parallel to the surface of the bed and transmitting the linear force to the workpiece clamping unit. The driving force transmitting mechanism comprises a helical driving member coaxially fixed to the output shaft of the motor and provided with a helical groove in the circumference thereof, a driven member engaged with the helical groove so as to be moved along the axis of the output shaft of the motor when the helical driving member is rotated, and a transmission mechanism for converting the movement of the driven member along the axis of the output shaft of the motor into a movement parallel to the surface of the bed of the sewing machine and transmitting the movement parallel to the surface of the bed of the sewing machine to the workpiece clamping unit.

This prior art workpiece clamping unit driving mechanism is intended to use a cylindrical cam, a worm or the like as the helical driving member, and a cylindrical roller, a worm wheel or the like as the driven member. Therefore, this prior art workpiece clamping unit driving mechanism has technical problems that the motor must be disposed with its output shaft in parallel to the bed shaft of the sewing machine, has a complicated construction and is difficult to manufacture. Particularly, it is difficult to engage the helical driving member and the driven member so that the driven member is fitted closely in the groove of the helical driving member and low friction acts between the helical driving means and the driven member, the workpiece clamping unit driving mechanism is liable to rattle due to gaps between the driven member and the walls defining the groove of the helical driving member in which the driven member is fitted, and hence it is very difficult to move the workpiece clamping unit accurately along the surface of the bed. Moreover, the helical driving member or the driven member needs to be changed soon to stop play between the helical driving member and the driven member, and the change of the helical driving member or the driven member requires troublesome work.

Suppose, for example, that a cylindrical cam 91 and a roller 93 shown in FIG. 8 are used as the helical driving member and the driven member, respectively, the roller 93 is fitted in a cam groove formed in the circumference of the cylindrical cam 91 and is in engagement with the side surfaces 91*a* of the cam groove. If there is any gap between the side surface 91*a* of the cam groove and the roller 93, there will be a lost motion in a driven lever 92 holding the roller 93 relative to the movement of the cylindrical cam 91 and, consequently, the workpiece clamping unit of a workpiece clamping mechanism is unable to carry the workpiece correctly and hence it is difficult to position the workpiece correctly. Consequently, the quality of bar tacking stitches is deteriorated.

Since the driven lever 92 holding the roller 93 turns about an axis C92, the distance between the axis C93 of the roller 93 and the axis C91 of the cylindrical cam 91 varies according to the variation of the angular displacement of the driven lever 92. Therefore, the side surfaces 91*a* of the cam groove must be complicated curved surfaces and a special machining apparatus is necessary to form the cam groove; that is, the cam groove must be formed by an eccentric cutting apparatus capable of displacing the center C95 of a cutting tool 95 in a direction perpendicular to the axis C91 of the cylindrical cam 91 according to the rotation of the cylindrical cam to make the center C95 of the cutting tool 95 coincide with the center C93 of the roller 93 which turns about the center axis C92. Since the cylindrical cam 91 and the roller 93 engaged with the cylinder cam 91 must be formed in a high accuracy, it is more difficult to form the cylindrical cam 91 than to form a general plane cam, and the use of the combination of the cylindrical cam 91 and the roller 93 increases the manufacturing cost of the bar tacking machine.

Since the roller 93 held by the driven lever 92 and engaged with the cylindrical cam 91 slides along the circumference of the cylindrical cam 91 and move along the axis of the cylindrical cam 91 as the cylindrical cam 91 is rotated, the roller 93 needs to slide against sliding friction through a long distance, so that the side surfaces 91*a* of the cam groove, and the roller 93 are abraded rapidly. Since the roller 93 moves in the cam groove defined by the opposite side surfaces 91*a*, it is difficult to achieve simultaneously both the smooth rotation of the roller 93 and the elimination of the play of the roller 93 in the cam groove defined by the side surfaces 91*a*, and the sliding friction between the side surfaces 91*a* of the cam groove and the roller 93 is inevitably high. There is no means for eliminating the play of the movement of the workpiece clamping mechanism in X- and Y-directions resulting from the abrasion of the side surfaces 91*a* of the cam groove or the roller 93 held by the driven lever 92 other than a means which changes the cylindrical cam 91 or the roller 93 held by the driven lever 92, which increases maintenance costs.

A workpiece clamping unit driving mechanism for a sewing machine disclosed in JP-B No. 60-17548 comprises a motor disposed above the bed of the sewing machine, a motor disposed inside the bed, timing pulleys fixedly mounted on the output shafts of the motors, respectively, timing belts driven by the timing belt pulleys, an X-axis block fixed to the X-axis timing belt, a Y-axis block fixed to the Y-axis timing belt, an X-axis guide rail for guiding the X-axis block, and a Y-axis guide rail for guiding the Y-axis block, fixed to the X-axis block. The X-axis block is moved along the X-axis guide rail, the Y-axis block is moved along the Y-axis guide rail to move the workpiece clamping unit fixed to the Y-axis block in X- and Y-directions.

If the workpiece clamping unit driving mechanism has large play owing to the elongation of the timing belts or backlashes between the timing belts and the corresponding timing belt pulleys, the workpiece cannot be accurately fed, the workpiece cannot be accurately positioned, and thereby the quality of bar tacking stitches is deteriorated. Moreover, the mechanism for guiding the workpiece clamping unit in the X- and the Y-direction is complicated, needs precision parts to drive the workpiece clamping unit smoothly and hence needs a high manufacturing cost.

SUMMARY OF THE INVENTION

Accordingly, it is a first object of the present invention to provide a durable workpiece clamping unit driving mechanism for a sewing machine, capable of effectively preventing the dislocation of a workpiece during bar tacking stitching operation and of forming bar tacking stiches of an improved quality.

A second object of the present invention is to provide a workpiece clamping unit driving mechanism for a sewing machine, having a simple construction, easy to manufacture and capable of reducing the manufacturing cost of the sewing machine.

A third object of the present invention is to provide a workpiece clamping unit driving mechanism for a sewing machine, capable of being adjusted for play elimination without changing the component parts and of facilitating maintenance work.

According to a first aspect of the present invention, a workpiece clamping unit driving mechanism for a sewing machine which clamps and carries a workpiece along the surface of its bed by a workpiece clamping unit during stitching operation comprises: a driving means comprising first and second drive shafts supported for rotation perpendicularly to the upper surface of the bed, first and second driving sources for driving the first and the second drive shaft, and first and second compound plate cams fixedly mounted respectively on the coaxial shaft to the first and the second drive shaft; and a motion converting means for converting the angular motions of the first and the second drive shaft into motions of the workpiece clamping unit parallel to the upper surface of the bed of the sewing machine, having one side interlocked with the first and the second compound plate cam and the other side interlocked with the workpiece clamping unit. The motion converting means converts the angular motions of the drive shafts driven for rotation by the driving sources into corresponding linear motions of the workpiece clamping unit in directions parallel to the surface of the bed of the sewing machine.

The driving means employing the compound plate cam which are relatively easy to manufacture has a simple construction and can be manufactured at a relatively low cost. Since the friction between the compound plate cam and the motion converting means is relatively low, the workpiece clamping unit driving mechanism has an extended useful life and high durability. Since the motion converting means has functional members disposed on the opposite sides of the compound plate cams, the component parts of the workpiece clamping unit driving mechanism can be manufactured and assembled so that there will not be any excessive play in the workpiece clamping unit driving mechanism, only low friction is produced between the component parts during operation, the workpiece clamping unit clamping a work piece can be accurately moved along the surface of the bed and, consequently, bar tacking stitches can be stitched in a high quality.

In the workpiece clamping unit driving mechanism according to the present invention, the motion converting means may comprise: a first drive lever having a middle portion pivotally supported on the bed of the sewing machine, a bifurcated arm having branch arms respectively extending on the opposite sides of the first compound plate cam, and a straight arm; rollers held on the branch arms of the bifurcated arm of the first drive lever so as to be in engagement with upper and lower plate cams of the first compound plate cam, respectively, a pin fixed to an end portion of the straight arm of the first drive lever and fitted in a slot formed in a feed plate carrying member included in the workpiece clamping unit; a second drive lever having a middle portion pivotally supported on the bed of the sewing machine, a bifurcated arm having branch arms respectively extending on the opposite sides of the second compound plate cam, and a straight arm interlocked with the workpiece clamping unit; rollers held on the branch arms of the bifurcated arm of the second drive lever so as to be in engagement with upper and lower plate cams of the second compound plate cam, respectively; and a pin fitted in a hole formed in a arch clamp frame included in the workpiece clamping unit.

Since the rollers roll along the cam surfaces of the upper and the lower cam, friction between the motion converting means and the driving means is further reduced, which contributes to extend the useful life and to enhance the durability of the workpiece clamping unit driving mechanism. Since each of the rollers is in contact at one point with the corresponding one of the upper and the lower cam of the compound plate cams, the rollers are able to roll smoothly and the abrasion of the rollers is suppressed.

In the workpiece clamping unit driving mechanism according to the present invention, the driving sources may be stepping motors, the stepping motors may be fixedly held with the axes of their output shafts extended perpendicularly to the upper surface of the bed on motor bases fastened to the bed of the sewing machine, and the motor bases may be moved in parallel to the upper surface of the bed of the sewing machine for positional adjustment.

Since the stepping motors are attached to the motor bases fixed to the bed of the sewing machine with the axes of their output shafts extended perpendicularly to the upper surface of the bed of the sewing machine, and the positions of the stepping motors with respect to horizontal directions parallel to the upper surface of the bed are adjustable, the clearances between the compound plate cams and the corresponding parts of the motion converting means can be adjusted by adjusting the positions of the stepping motors. Therefore, play of the components of the workpiece clamping unit driving mechanism can be easily adjusted without changing parts including the compound plate cams and the rollers of the motion converting means.

In the workpiece clamping unit driving mechanism according to the present invention, the driving sources may be an X-axis stepping motor for driving the workpiece clamping unit in directions parallel to an X-axis and a Y-axis stepping motor for driving the workpiece clamping unit in directions parallel to a Y-axis, the two stepping motors may be disposed on the opposite sides of a bed shaft included in the sewing machine, respectively, under the bed of the sewing machine, and the compound plate cams may be fixedly mounted on the output shafts of the stepping motors, respectively, and the stepping motors may drive the drive levers of the motion converting means, respectively.

In the workpiece clamping unit driving mechanism according to the present invention, at least one of the two rollers supported on the branch arms of the bifurcated arm of the first drive lever may be rotatably supported on an eccentric shaft to adjust the distance between the two rollers respectively on the opposite sides of the first compound plate cam by turning the eccentric shaft, and at least one of the two rollers supported on the branch arms of the bifurcated arm of the second drive lever may be rotatably supported on an eccentric shaft to adjust the distance between the two rollers respectively on the opposite sides of the second compound plate cam by turning the eccentric shaft.

Clearances between the cams of the compound plate cams and the corresponding rollers can be adjusted by turning the eccentric shafts supporting the rollers on the branch arms, so that play of the components of the workpiece clamping unit driving mechanism can be easily corrected without changing parts including the compound plate cams and the rollers of the motion converting means.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 7:
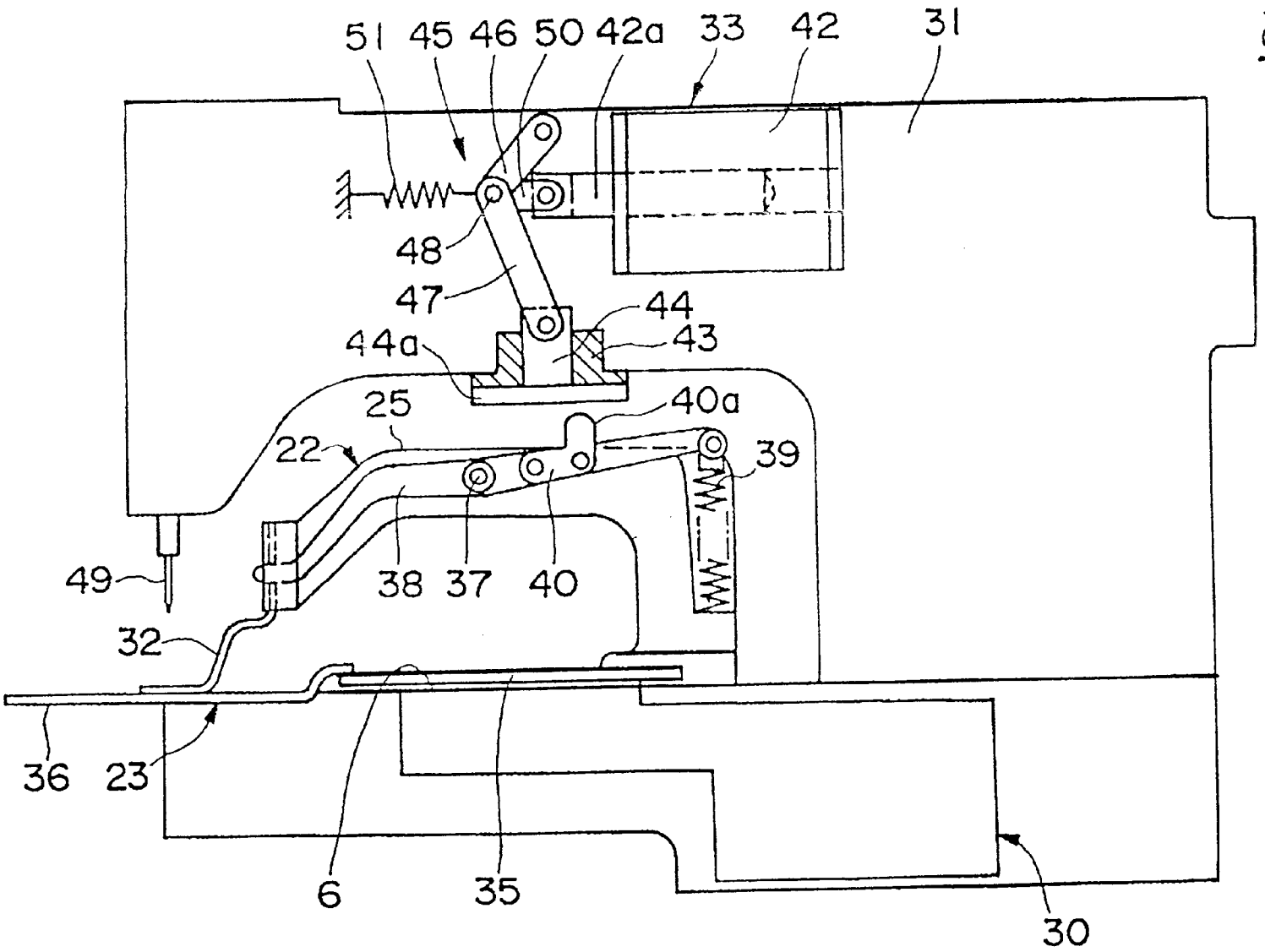
FIG. 7 is a typical sectional view of a bar tacking machine.
Figure 8:
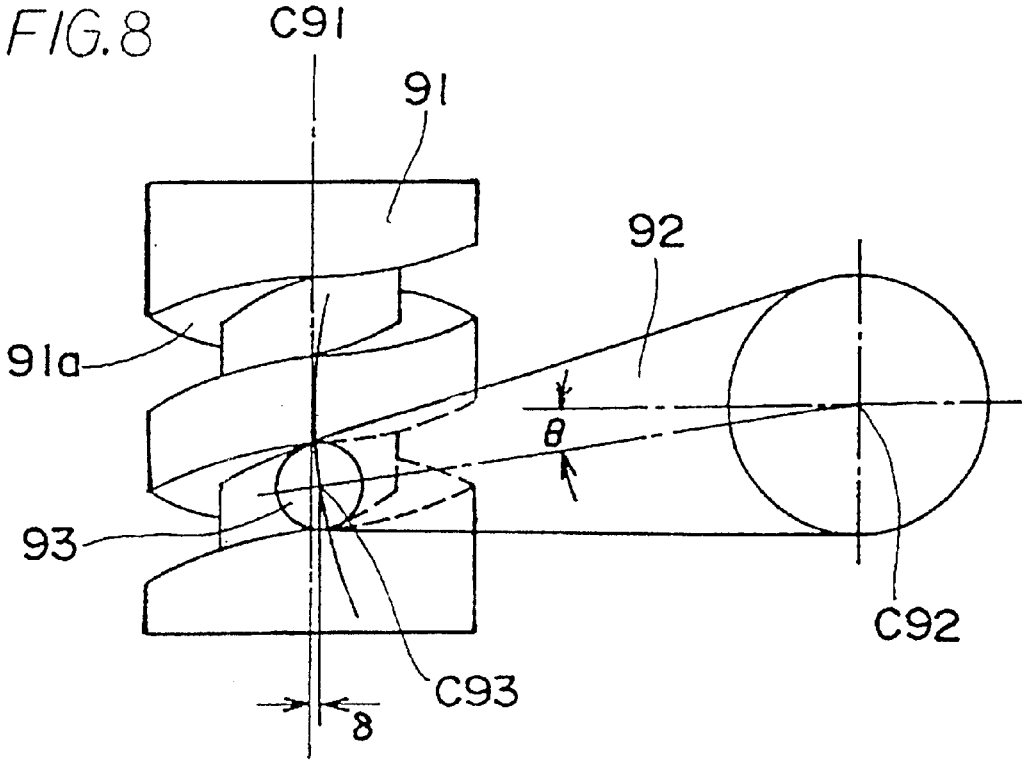
FIG. 8 is a front view of a cylindrical cam employed in a conventional workpiece clamping unit driving mechanism.
Figure 9:
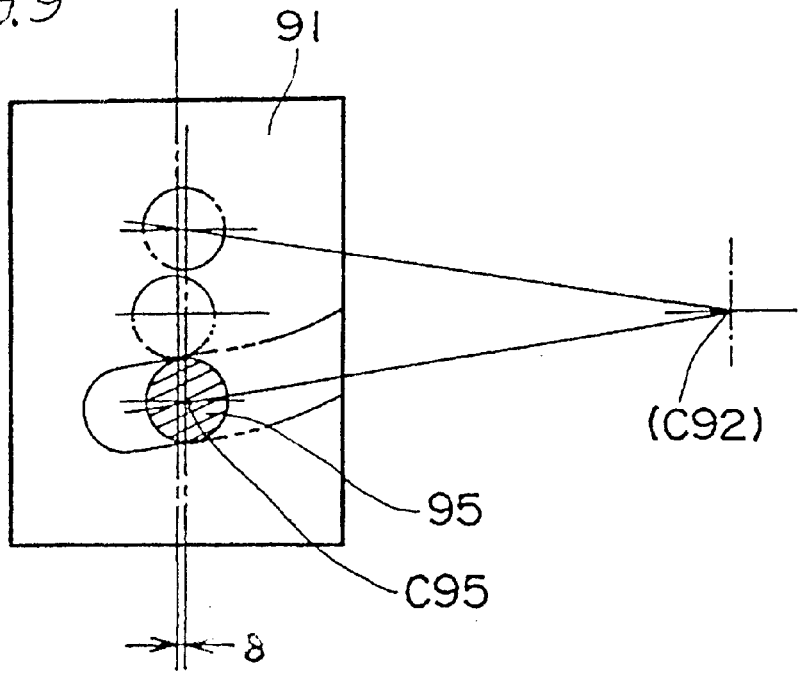
FIG. 9 is a diagrammatic view of assistance in explaining the cylindrical cam of FIG. 8.

Referring to FIG. 7 schematically showing a bar tacking machine, a workpiece clamping unit 22 is disposed on a bed 6, a workpiece clamping unit driving mechanism 30 is disposed within the bed 6 to drive the workpiece clamping unit 22 for movement in directions parallel to an X-axis and a Y-axis perpendicular to the X-axis, and a workpiece clamping unit lifting mechanism 33 is formed in an arm 31 to move the workpiece clamping unit 22 vertically.

Figure 1:
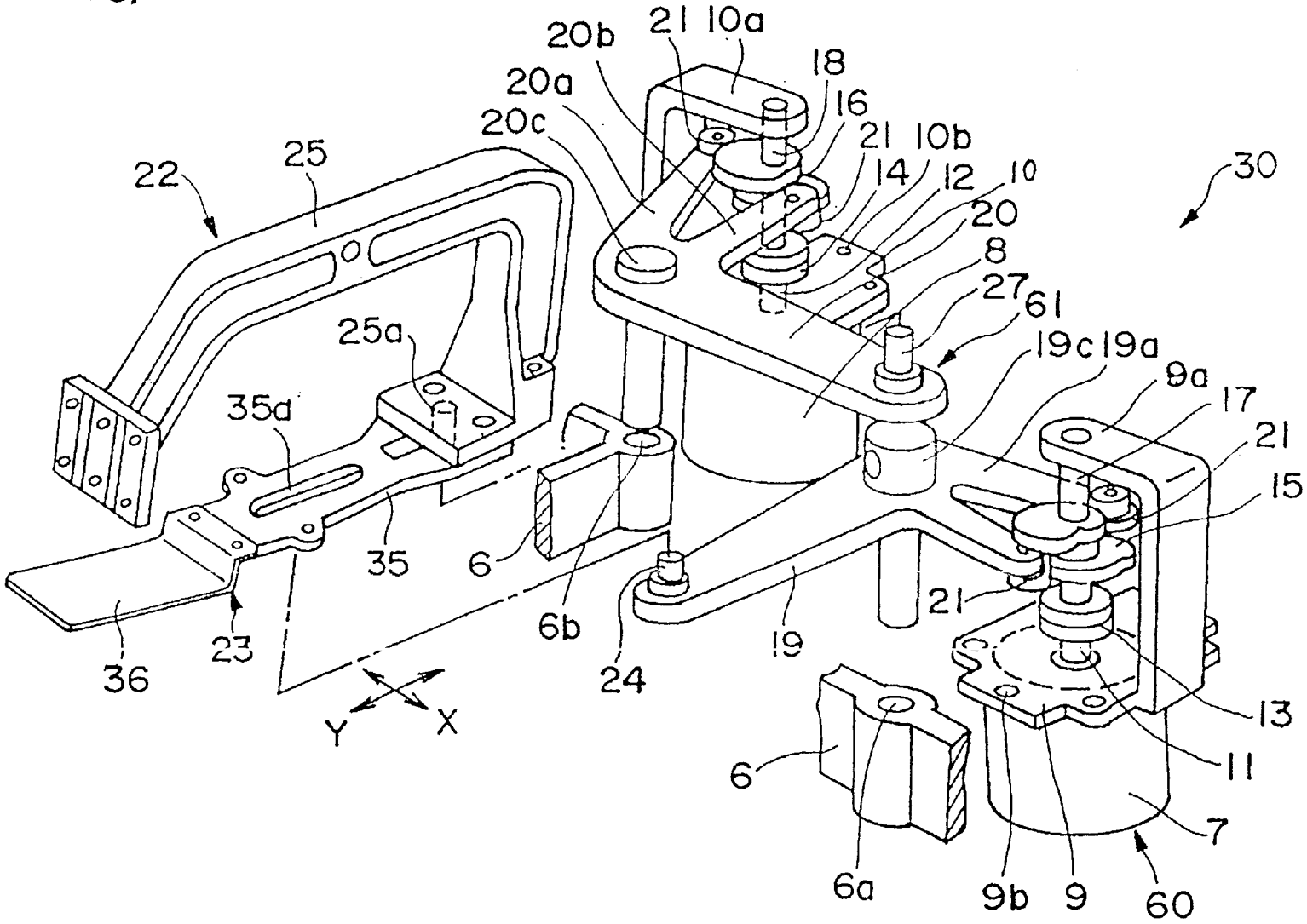
FIG. 1 is a partly exploded perspective view of a workpiece clamping unit driving mechanism in a preferred embodiment according to the present invention.

The workpiece clamping unit 22 has a arch clamp frame 25, a arch clamp foot 32 vertically movably supported on an extremity of the arch clamp frame 25, a feed plate carrying member 35 fixedly attached to a base end of the arch clamp frame 25 so as to extend along the upper surface of the bed 6, and a feed plate 36 fixed to an extremity of the feed plate carrying member 35 as shown in FIG. 1 to clamp a workpiece between the arch clamp foot 32 and the feed plate 36. The feed plate 36 is provided with a needle locating slot, not shown. The feed plate carrying member 35 and the feed plate 36 constitute a feed plate assembly 23. An arch clamp foot lever 38 is supported for swing motion in its middle portion by a pin 37 on the arch clamp frame 25. The front end of the arch clamp foot lever 38 is attached to the arch clamp foot 32. A compression spring 39 is compressed between the base end of the arch clamp foot lever 38 and the base end of the arch clamp frame 25 to press the arch clamp foot 32 against the feed plate 36. A contact member 40 having a projection 40*a* is attached to the base end of the arch clamp foot lever 38 with the projection 40*a* disposed opposite to the lower surface of a pressing member 44 included in a arch clamp foot lifting device 33.

The arch clamp foot lifting device 33 comprises a solenoid actuator 42, the pressing member 44 guided for vertical movement by a guide bushing 43 fixed to the arm 31, and a linkage 45 operated by the solenoid actuator 42 to move the pressing member 44 vertically. The linkage 45 comprises an upper link 46 having an upper end pivotally connected by a pin to the arm 31, a lower link 47 having an upper end pivotally connected to the lower end of the upper link 46 by a pin 48 and a lower end pivotally connected to the pressing member by a pin, a connecting link 50 having one end pivotally connected to the upper link 46 and the lower link 47 by the pin 48 and the other end pivotally connected to one end of a plunger 42*a* included in the solenoid actuator 42 by a pin, and a return spring 51 extended between the pin 48 and the arm 31.

When the solenoid of the solenoid actuator 42 is not energized, a front end portion of the plunger 42*a* is projected from the solenoid by the resilience of the return spring 51, the upper link 46 and the lower link 47 extend at an angle to each other, and the pressing member 44 is raised to its upper position with its flange 44*a* in contact with the lower surface of the guide bushing 43 as shown in FIG. 7. When the solenoid of the solenoid actuator 42 is energized, the plunger 42*a* is pulled into the solenoid against the resilience of the return spring 51, the connecting link 50 is pulled to the right, as viewed in FIG. 7, and the lower end of the lower link 47 is moved downward. Consequently, the flange 44*a* of the pressing member 44 comes into contact with the projection 40*a* of the contact member 40 and depresses the contact member 44 fixed to the base end of the arch clamp foot lever 38, so that the arch clamp foot lever 38 is turned clockwise, as viewed in FIG. 7, on the pin 37 against the resilience of the compression spring 39 to raise the arch clamp foot 32, whereby a workpiece clamped between the arch clamp foot 32 and the feed plate 36 is released. When the solenoid of the solenoid actuator 42 is de-energized, the connecting link 50 and the plunger 42*a* are pulled to the left, as viewed in FIG. 7 by the resilience of the return spring 51, and the upper link 46 and the lower link 47 are turned on the pin 48 so as to extend at an angle to each other, so that the lower end of the lower link 47 moves upward. Consequently, the pressing member 44 is lifted up, the flange 44*a* is separated from the projection 40*a* of the contact member 40 and brought into contact with the lower surface of the guide bushing 43, so that the arch clamp foot lever 38 is turned counterclockwise, as viewed in FIG. 7, by the resilience of the compression spring 39 to clamp the workpiece between the arch clamp foot 32 and the feed plate 36 by lowering the arch clamp foot 32.

The workpiece is clamped between the arch clamp foot 32 and the feed plate 36, the workpiece clamping unit 22 is moved in directions parallel to the X-axis and the Y-axis on the upper surface of the bed 6 by the workpiece clamping unit driving mechanism 30, and stitches are formed by a needle 49 to form a bar tacking stitch.

Figure 2:
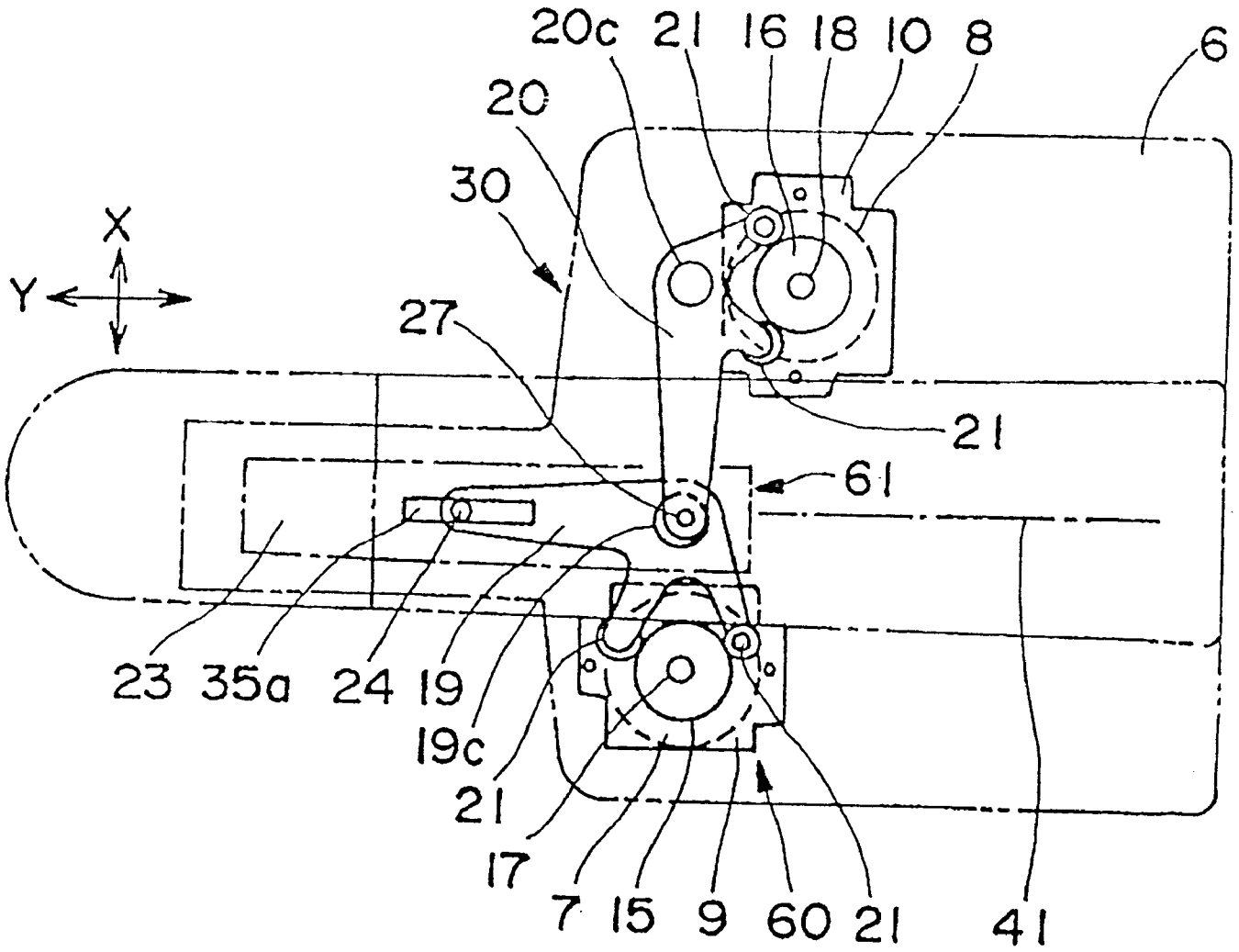
FIG. 2 is a plan view of a driving unit and a motion converting unit included in the workpiece clamping unit driving mechanism of FIG. 1.

The workpiece clamping unit driving mechanism 30 drives the workpiece clamping unit 22 for movement on the bed 6. As shown in FIGS. 1 and 2, the workpiece clamping unit driving mechanism 30 has a driving unit 60, and a motion converting unit 61. The driving unit 60 has an X-axis stepping motor 7, a Y-axis stepping motor 8, an X-axis drive shaft 11, driven by the X-axis motor 7, a Y-axis drive shaft 12 driven by the Y-axis stepping motor 8, and an X-axis compound plate cam 15 fixedly mounted on the X-axis drive shaft 11, and a Y-axis compound plate cam 16 fixedly mounted on the Y-axis drive shaft 12. The stepping motors 7 and 8 are attached to motor bases 9 and 10 fastened to the bed 6 of the sewing machine so that the output shafts thereof extend perpendicularly to the upper surface of the bed 6. The motion converting unit 61 converts angular motions of the drive shafts 11 and 12 driven for rotation by the stepping motors 7 and 8 into motions of the workpiece clamping unit parallel to the upper surface of the bed 6. The compound plate cams 15 and 16 are conjugate cams each formed by combining a pair of plate cams. The drive shafts 11 and 12 are disposed coaxially with the output shafts of the stepping motors 7 and 8 and are driven for rotation by the stepping motors 7 and 8. Usually, the drive shafts 11 and 12 are the output shafts of the stepping motors 7 and 8. As shown in FIG. 2, the motors 7 and 8 are disposed on the opposite sides of a bed shaft 41 supported for rotation in the bed 6, respectively. The bed shaft 41 drives a shuttle through a driver, not shown. The motor bases 9 and 10 are fastened to the bed 6 with bolts screwed through through holes 9*b* and 10*b* in the bed 6. The through holes 9*b* and 10*b* are formed in a diameter greater than that of the bolts to enable the positional adjustment of the motor bases 9 and 10, hence the motors 7 and 8 with respect horizontal directions parallel to the upper surface of the bed 6.

Figure 3:
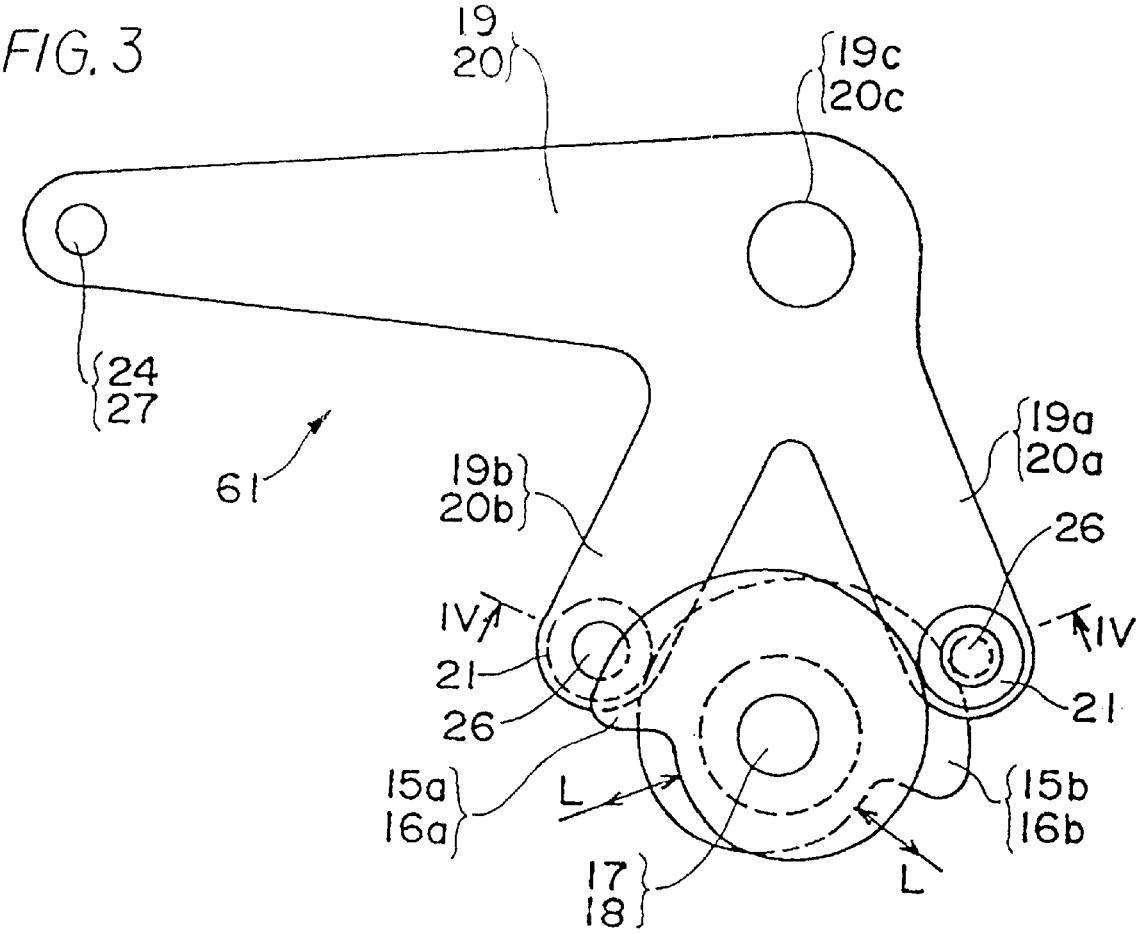
FIG. 3 is a plan view of a compound cam and a drive lever included in included in the workpiece clamping unit driving mechanism of FIG. 1.
Figure 4:
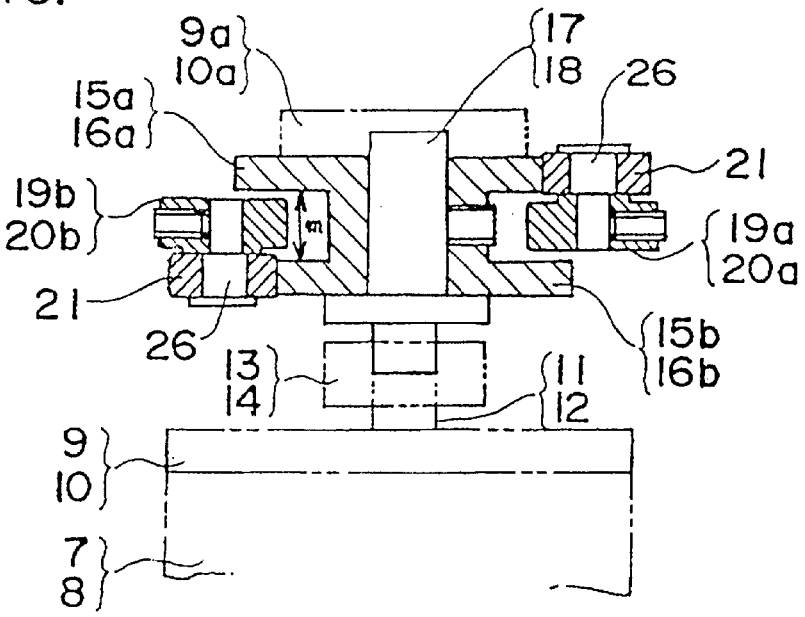
FIG. 4 is a sectional view taken on line IV—IV in FIG. 3.

As shown in FIG. 1, a cam shaft 17 and the drive shaft 11 of the X-axis stepping motor 7 are connected coaxially by a shaft coupling 13, and the X-axis compound plate cam 15 is fixed to the cam shaft 17. An upper end portion of the cam shaft 17 is supported for rotation on a bracket 9*a* formed by bending a portion of the motor base 9. As shown in FIGS. 3 and 4, the X-axis compound plate cam 15 is formed by fixing an upper cam 16*a* and a lower cam 15*b* to the cam shaft 17 with an interval m therebetween and in a predetermined phase difference. A pair of rollers 21 are in contact with the respective cam surfaces of the upper cam 15*a* and the lower cam 15*b* of the compound plate cam 15, respectively. The upper cam 15*a* and the lower cam 15*b* have the same lift L and are designed and disposed in the predetermined phase difference so that the horizontal distance between points on the cam surfaces thereof in contact with the rollers 21 is always the same and the upper cam 15*a* and the lower cam 15*b* move the rollers 21 in opposite directions, respectively.

A cam shaft 18 and the drive shaft 12 of the Y-axis stepping motor 8 are connected coaxially by a shaft coupling 14, and the Y-axis compound plate cam 16 is fixed to the cam shaft 18. An upper end portion of the cam shaft 18 is supported for rotation on a bracket 10*a* formed by bending a portion of the motor base 10. As shown in FIGS. 3 and 4, the Y-axis compound plate cam 16, similarly to the X-axis compound plate cam 15, is formed by fixing an upper cam 16*a* and a lower cam 16*b* to the cam shaft 18 with an interval m therebetween and in a predetermined phase difference. A pair of rollers 21 are in contact with the respective cam surfaces of the upper cam 16*a* and the lower cam 16*b* of the compound plate cam 15, respectively. The upper cam 15*a* and the lower cam 15*b* have the same lift L and are designed and disposed in the predetermined phase difference so that the horizontal distance between points on the cam surfaces thereof in contact with the rollers 21 is always the same and the upper cam 16*a* and the lower cam 16*b* move the rollers 21 in opposite directions, respectively.

The motion converting unit 61 has an X-axis drive lever 19 and a Y-axis drive lever 20. The X-axis drive lever 19 has a shape substantially resembling the letter L. A support shaft 19*c* projecting from a middle portion of the X-axis drive lever 19 is fitted in a hole 6*a* formed in the bed 6 to support the X-axis drive lever 19 for turning on the bed 6. A pin 24 attached to an end portion of a straight arm of the X-axis drive lever 19 is fitted in a slot 35*a* formed in the feed plate carrying member 35 of the feed plate assembly 23 so as to be movable along the slot 35*a*. The X-axis drive lever 19 has a bifurcated arm having branch arms 19*a* and 19*b*. The rollers 21 are supported for rotation on the end portions of the branch arms 19*a* and 19*b* so as to be in contact with the cam surfaces of the upper cam 15*a* and the lower cam 15*b* spaced from each other by the interval m, respectively, to form a positive motion cam mechanism. The slot 35*a* is substantially parallel to the Y-axis. The roller 21 supported for rotation above the upper surface of the branch arm 19*a* is in rolling contact with the cam surface of the upper cam 15*a*, and the roller 21 supported for rotation below the lower surface of the other branch arm 19*b* is in rolling contact with the cam surface of the lower cam 15*b*. The center distance between the support shaft 19*c* and the pin 24 is longer than that between the support shaft 19*c* and each of the rollers 21.

The Y-axis drive lever 20 has a shape substantially resembling the letter L. A support shaft 20*c* projecting from a middle portion of the Y-axis drive lever 20 is fitted in a hole 6*b* formed in the bed 6 to support the Y-axis drive lever 20 for turning on the bed 6. A pin 27 attached to an end portion of a straight arm of the Y-axis drive lever 20 is fitted in a hole 25*a* formed in the arch clamp frame 25 of the workpiece clamping unit 22. The Y-axis drive lever 20 has a bifurcated arm having branch arms 20*a* and 20*b*. The rollers 21 are supported for rotation on the end portions of the branch arms 20*a* and 20*b* so as to be in contact with the cam surfaces of the upper cam 16*a* and the lower cam 16*b* spaced from each other by the interval m, respectively, to form a positive motion cam mechanism. The slot 35*a* is substantially parallel to the Y-axis. The roller 21 supported for rotation above the upper surface of the branch arm 20*a* is in rolling contact with the cam surface of the upper cam 16*a*, and the roller 21 supported for rotation below the lower surface of the other branch arm 20*b* is in rolling contact with the cam surface of the lower cam 16*b*. The center distance between the support shaft 20*c* and the pin 27 is longer than that between the support shaft 20*c* and each of the rollers 21.

In operation, a controller, not shown, provides a control signal to drive the drive shaft 11 of the X-axis stepping motor 7 for rotation in the normal or the reverse direction to turn the compound plate cam 15. Consequently, the X-axis drive lever 19 is turned by the compound plate cam 15. The maximum angular displacement of the X-axis drive lever 19 is dependent on the lift L of the cams 15*a* and 15*b*. The rollers 21 rotatably supported on the end portions of the branch arms 19*a* and 19*b* roll along the respective cam surfaces of the upper cam 16*a* and the lower cam 15*b*, respectively, to turn the X-axis lever 19 on the support shaft 19*c*. Consequently, the arch clamp frame 25 and the feed plate assembly 23 of the workpiece clamping unit 22 are moved in the normal or the reverse direction parallel to the X-axis by the pin 24 fitted in the slot 35*a* of the feed plate carrying member 35 of the feed plate assembly 23. Practically, the arch clamp frame 25 and the feed plate assembly 23 turn about the center axis of the hole 25*a* of the arch clamp frame 25.

When the drive shaft 12 of the Y-axis stepping motor 8 is driven for rotation in the normal or the reverse direction to turn the compound plate cam 16, the Y-axis drive lever 20 is turned by the compound plate cam 16. The maximum angular displacement of the Y-axis drive lever 20 is dependent on the lift L of the cams 16*a* and 16*b*. The rollers 21 rotatably supported on the end portions of the branch arms 20*a* and 20*b* roll along the respective cam surfaces of the upper cam 16*a* and the lower cam 16*b*, respectively, to turn the Y-axis lever 20 on the support shaft 20*c*. Consequently, the arch clamp frame 25 and the feed plate assembly 23 of the workpiece clamping unit 22 are moved in the normal or the reverse direction parallel to the Y-axis by the pin 27 rotatably fitted in the hole 25*a* of the arch clamp frame 25. When the feed plate assembly 23 is thus moved along the Y-axis, the pin 24 slides in the slot 35*a* of the feed plate carrying member 35 of the feed plate assembly 23.

The workpiece clamping unit 22 is moved optionally in directions along the X-axis and the Y-axis by individually driving the X-axis stepping motor 7 and the Y-axis stepping motor 8 by predetermined electric signals to carry a workpiece clamped between the arch clamp foot 32 and the feed plate 36 to stitch a desired bar tack. The center distance between the support shaft 19*c* and the pin 24 is longer than that between the support shaft 19*c* and each of the rollers 21, and the center distance between the support shaft 20*c* and the pin 27 is longer than that between the support shaft 20*c* and each of the rollers 21. Therefore, the swing motions of the branch arms 19*a*, 19*b*, 20*a* and 20*b* caused by the compound plate cams 15 and 16 are multiplied by the leverages of the drive levers 19 and 20, and the multiplied motions appear at the pins 24 and 27.

When stitching the bar tack, the workpiece clamping unit 22 has play in the X-directions and the Y-directions if there are excessively great clearances between the rollers 21 and the upper cam 15*a* and the lower cam 15*b* of the X-axis compound plate cam 15 and between the rollers 21 and the upper cam 16*a* and the lower cam 16*b* of the Y-axis compound plate cam 16 and hence the bar tack cannot be accurately stitched. The clearances between the rollers 21 and the cams 15*a*, 15*b* of the X-axis compound plate cam 15 and between the rollers 21 and the upper cam 16*a* and the lower cam 16*b* of the Y-axis compound plate cam 16 can be corrected by the following method. The upper surface of the bed 6 is opened, and the motor bases 9 and 10 are moved to adjust the positions of the axes of rotation of the compound plate cams 15 and 16 relative to the bed 6 to adjust the clearances to appropriate values. Appropriate clearances can be formed between the rollers 21 supported on the branch arms 19*a*, 19*b*, 20*a* and 20*b* of the drive levers 19 and 20, and the cam surfaces of the cams 16*a*, 15*b*, 16*a* and 16*b* of the compound plate cams 15 and 16, respectively, by thus adjusting the positions of the axes of rotation of the compound plate cams 15 and 16 with respect to the axes of turning of the X-axis drive lever 19 and the Y-axis drive lever 29, i.e., the center axes of the support shafts 19*c* and 20*c*.

Figure 5:
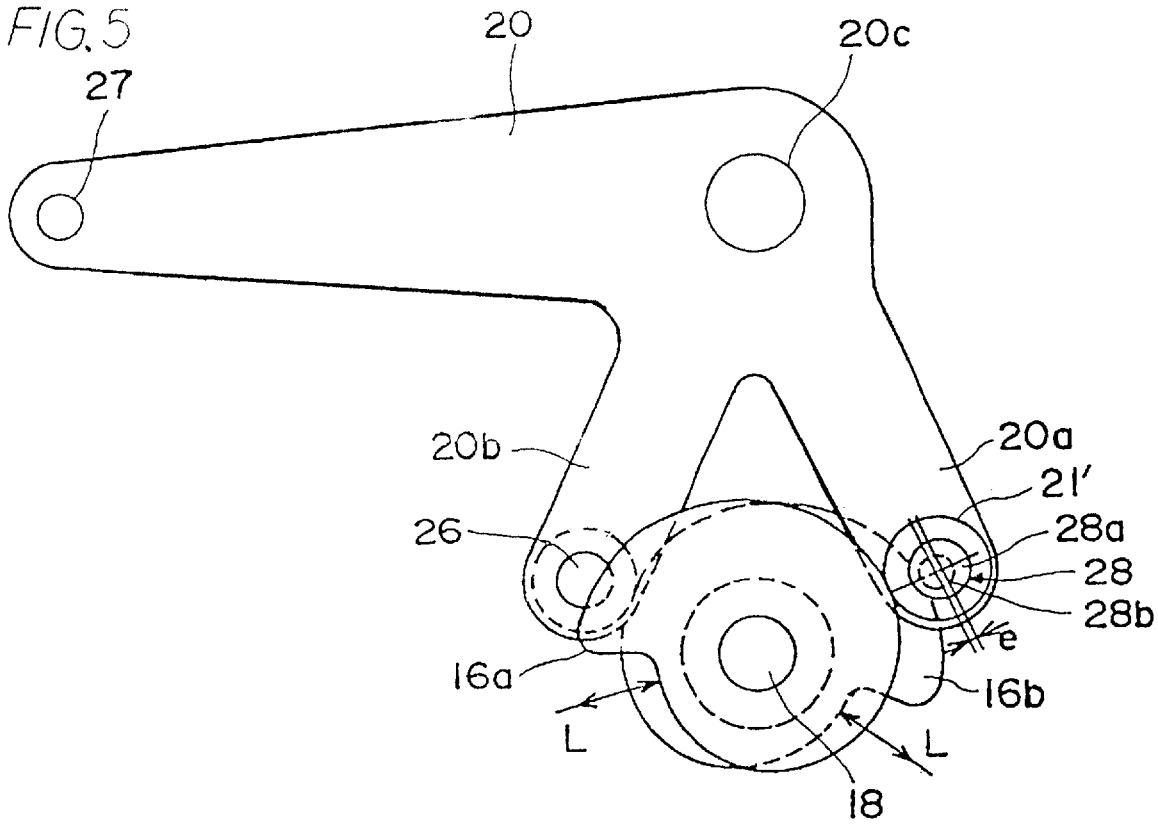
FIG. 5 is a plan view of another drive lever, and another compound plate cam.
Figure 6:
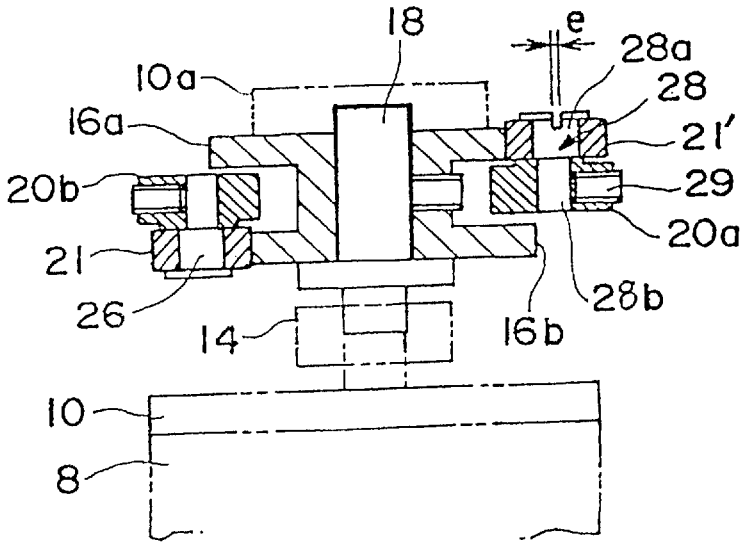
FIG. 6 is a sectional view of the drive lever and the compound plate cam in FIG. 5.

FIGS. 5 and 6 show another possible Y-axis drive lever 20. In this Y-axis drive lever 20, rollers 21 and 21' are supported for rotation on end portions of branch arms 20*a* and 20*b* of the drive lever 20. The roller 21' is supported by an eccentric shaft 28 on the end portion of the branch arm 20*a*. The eccentric shaft 28 has a cylindrical base portion 28*b* held on the branch arm 20*a*, and a cylindrical, eccentric support portion 28*a* having an axis displaced from the geometric center axis of the base portion 28*b* and supporting the roller 21'. After properly adjusting the angular position of the eccentric shaft 28, the eccentric shaft 28 is fixed to the branch arm 20*a* with a set screw 29.

The set screw 29 is unfastened and the eccentric shaft 28 is turned to adjust the direction of the eccentric arm of the support portion 28*a*, whereby the roller 21' is shifted. Thus, the distance between the two rollers 21 and 21' can be adjusted. Naturally, both the rollers 21 and 21' supported on the branch arms 20*a* and 20*b* may be supported by eccentric shafts 28. One of or both the rollers 21 supported on the branch arms 19*a* and 19*b* of the X-axis drive lever 19 may be supported by eccentric shafts 28. The positional adjustment of the roller 21' is possible even if the eccentric support portion 28*a* is fixed to the branch lever 20*a*, and the roller 21' is supported for rotation on the base portion 28*b*.

Although the invention has been described in its preferred form with a certain degree of particularity, obviously many changes and variations are possible therein. It is therefore to be understood that the present invention may be practiced otherwise than as specifically described herein without departing from the scope and spirit thereof

What is claimed is:

1. A workpiece clamping unit driving mechanism for a sewing machine which clamps and carries a workpiece along the surface of its bed by a workpiece clamping unit during stitching operation, said workpiece clamping unit driving mechanism comprising:

a driving means comprising first and second drive shafts adapted to be supported for rotation perpendicularly to the upper surface of the bed, first and second driving sources for driving the first and the second drive shafts, and first and second compound plate cams fixedly mounted respectively on coaxial shafts to the first and the second drive shafts; and a motion converting means for converting angular motions of the first and the second drive shafts into motions of the workpiece clamping unit parallel t6 the upper surface of the bed of the sewing machine, having one side interlocked with the first and the second compound plate cams and the other side adapted to be interlocked with the workpiece clamping unit.

2. The workpiece clamping unit driving mechanism according to claim 1, wherein the motion converting means comprise:

a first drive lever having a middle portion pivotally supported on the bed of the sewing machine, a bifurcated arm having branch arms respectively extending on the opposite sides of the first compound plate cam, and a straight arm;

rollers held on the branch arms of the bifurcated arm of the first drive lever so as to be in engagement with upper and lower plate cams of the first compound plate cam, respectively;

a pin fixed to an end portion of the straight arm of the first drive lever and adapted to be fitted in a slot formed in a feed plate carrying member included in the workpiece clamping unit;

a second drive lever having a middle portion pivotally supported on the bed of the sewing machine, a bifurcated arm having branch arms respectively extending on the opposite sides of the second compound plate cam, and a straight arm adapted to be interlocked with the workpiece clamping unit;

rollers held on the branch arms of the bifurcated arm of the second drive lever so as to be in engagement with upper and lower plate cams of the second compound plate cam, respectively; and a pin adapted to be fitted in a hole formed in a arch clamp frame included in the workpiece clamping unit.

3. The workpiece clamping unit driving mechanism according to claim 1, wherein the driving sources are stepping motors, the stepping motors are fixedly held with the axes of their output shafts extended perpendicularly to the upper surface of the bed on motor bases adapted to be fastened to the bed of the sewing machine, and the motor bases can be moved in parallel to the upper surface of the bed of the sewing machine for positional adjustment.

4. The workpiece clamping unit driving mechanism according to claim 2, wherein the driving sources are an X-axis stepping motor for driving the workpiece clamping unit in directions parallel to an X-axis and a Y-axis stepping motor for driving the workpiece clamping unit in directions parallel to a Y-axis, the two stepping motors are adapted to be disposed on the opposite sides of a bed shaft included in the sewing machine, respectively, under the bed of the sewing machine, and the compound plate cams are fixedly mounted on the coaxial shafts to the output shafts of the stepping motors, respectively, and the stepping motors drive the drive levers of the motion converting means, respectively.

5. The workpiece clamping unit driving mechanism according to claim 2, wherein at least one of the two rollers supported on the branch arms of the bifurcated arm of the first drive lever is rotatably supported on an eccentric shaft to adjust the distance between the two rollers respectively on the opposite sides of the first compound plate cam by turning the eccentric shaft, and at least one of the two rollers supported on the branch arms of the bifurcated arm of the second drive lever is rotatably supported on an eccentric shaft to adjust the distance between the two rollers respectively on the opposite sides of the second compound plate cam by turning the eccentric shaft.

* * * * *